US006508216B2

(12) United States Patent
Holmes et al.

(10) Patent No.: US 6,508,216 B2
(45) Date of Patent: Jan. 21, 2003

(54) SPARK PLUG BOOT KEEPER ASSEMBLY

(75) Inventors: James C Holmes, Mineral Ridge, OH (US); Suzanne Christine Nadasky, Newton Falls, OH (US); Rhonda A. Taylor, Cortland, OH (US); Harry J. Slaven, Canfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/855,009

(22) Filed: May 14, 2001

(65) Prior Publication Data

US 2002/0166528 A1 Nov. 14, 2002

(51) Int. Cl.[7] ..... F02P 15/00

(52) U.S. Cl. ..... 123/169 PA; 123/169 R; 123/169 PH

(58) Field of Search ..... 123/169 R, 169 PA, 123/169 PH; 439/125, 394, 128, 435, 438

(56) References Cited

U.S. PATENT DOCUMENTS 3,716,038 A * 2/1973 Bevacqua ..... 123/147
4,790,767 A * 12/1988 Sturdevan et al. ..... 439/125
4,859,194 A * 8/1989 Bartholomew ..... 439/125
5,445,535 A 8/1995 Phillips, Jr. et al. ..... 439/394
6,302,712 B1 * 10/2001 Delsole ..... 439/125

FOREIGN PATENT DOCUMENTS

DE 40 25 038 A1 * 2/1992 ..... B25B/27/00
FR 2 492 596 A * 4/1982 ..... H01R/4/48

* cited by examiner

*Primary Examiner*—Hieu T. Vo
(74) *Attorney, Agent, or Firm*—Thomas N. Twomey

(57) ABSTRACT

A spark plug boot keeper assembly interconnects between a spark plug boot and an internal surface of a surrounding structure which defines an elongated spark plug well. A pivoting member of the assembly is located above an annular upper shelf of the internal surface and a circumferential lower rib of the boot. When the boot is properly seated on the spark plug, the lower rib engages the upper shelf. Once engaged, the pivoting member pivots to lock the boot onto the spark plug. The pivot axis lies within an imaginary plane disposed perpendicular to a centerline of the elongated spark plug well.

17 Claims, 5 Drawing Sheets

SPARK PLUG BOOT KEEPER ASSEMBLY

TECHNICAL FIELD OF THE INVENTION

This invention relates to a spark plug boot keeper assembly and more particularly to a spark plug boot keeper assembly for a combustion engine.

BACKGROUND OF THE INVENTION

Spark plugs are known to have a male terminal protruding from a mid ceramic portion. An ignition wire terminal clip or female terminal press fits and thereby locks onto the male terminal of the spark plug. This high voltage electrical connection is surrounded by an elastomeric, electrically insulating, boot which is integral to the ignition wire and fits down snugly around the mid ceramic portion of the spark plug. In addition to the boot's insulating characteristics it also assures that the high voltage electrical connection remains clean and free of moisture.

In today's more complex combustion engines, the spark plug must be inserted into a deep spark plug well (typically surrounded by a heat dissipating head of an engine block) and then threaded into the spark plug hole in the head of the engine block. Since access to the spark plug within the well is limited and only the top of the spark plug is viewable, connection of the terminal clip inside the boot to the spark plug is cumbersome and visible inspection is difficult. The terminal clip must be made of a high strength electrically conductive metal in order to assure that the clip does not disengage from the spark plug thereby causing a rough running engine. The clip must be able to maintain its strength during vibrating engine conditions and after repeated engagement and disengagement's of the ignition wire to the spark plug during engine maintenance. If the female terminal clip were to unseat from the spark plug a rough running engine would result and warranty costs would increase.

In addition, the collection of heat or hotspots within the spark plug well can cause damage to the most durable of elastomeric spark plug boots. A damaged boot can contribute to high voltage arching from the ignition wire to the engine block weakening the sparking characteristics of the spark plug. To help resolve this problem, heat shields are known to surround the boot, evenly distributing and dissipating the otherwise damaging heat. Unfortunately, the heat shields further narrow the spark plug wells making plugging of the ignition wire terminal onto the spark plug and the visible inspection of the spark plug connection all the more difficult.

SUMMARY OF THE INVENTION

The present invention provides a spark plug boot keeper assembly which ensures that a spark plug boot is properly installed in a deep well and locked onto a spark plug. The spark plug boot assembly has a pivoting member which engages to a lock face. The pivoting member and the lock face are interconnected between an internal surface of a spark plug well and a spark plug boot. The elongated spark plug well is preferably concentric about a centerline. The internal surface is defined by an upper wall, an upper shelf, a lower wall, and a bottom shelf. The upper wall extends downward to the upper shelf. The upper shelf is preferably annular, and extends radially inward to a lower wall. The lower wall extends downward to a bottom shelf which is annular in shape and defines an aperture through which the spark plug extends from an engine block along the centerline.

The spark plug boot has a circumferential lower rib which extends radially outward and engages the upper shelf when the boot is properly and fully seated with the spark plug. The pivoting member is disposed above the upper shelf of the internal surface and the lower rib of the boot. The pivoting member has a pivoting axis lying within an imaginary plane disposed perpendicular to the centerline of the well. The pivoting member engages the locking face limiting axial movement of the boot with respect to the internal surface and thereby preventing disengagement of the boot from the spark plug.

A feature of the present invention is the ability to determine when a boot is fully seated on a spark plug disposed within a spark plug well.

Another feature of the invention is providing a secondary means, other than the ignition wire terminal clip snap fit engagement to the spark plug, which secures the boot to the spark plug.

Yet another feature of the invention is reduced warranty costs by eliminating unintentional unseating of the boot from the spark plug and by providing a more robust electrical connection design.

BRIEF DESCRIPTION OF THE DRAWINGS

The presently preferred embodiment of the invention is disclosed in the following description and accompanying drawings wherein.

DETAILED DESCRIPTION OF THE PREFERRED EMBODIMENT

Referring to FIGS. 1–8, a spark plug boot keeper assembly 20 of the present invention is shown capable of securing or locking a spark plug boot 22 onto a spark plug 24. The concept is such that different ignition wire dress angles can be incorporated into the boot 22 without interfering with the spark plug boot keeper assembly 20 since the top of the boot 22 is free of obstruction. Assembly 20 contains a conventional ignition wire terminal within the boot 22 (not shown) that provides the primary lock to the spark plug terminal 23. However, the terminal 23 can be designed with a reduced engagement force to aid in the high voltage electrical connection. This is made possible because of the features of the spark plug boot keeper assembly 20 described below.

Figure 7:
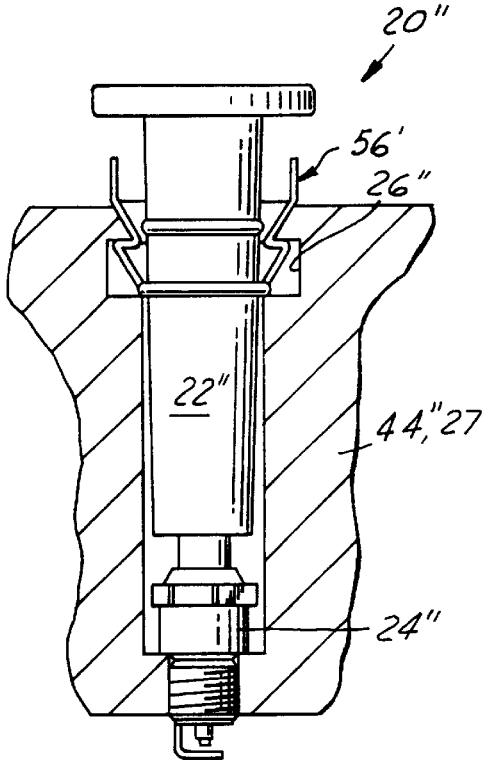
FIG. 7 is a cross-section side view of a third embodiment of a spark plug boot keeper assembly of the invention.
Figure 6:
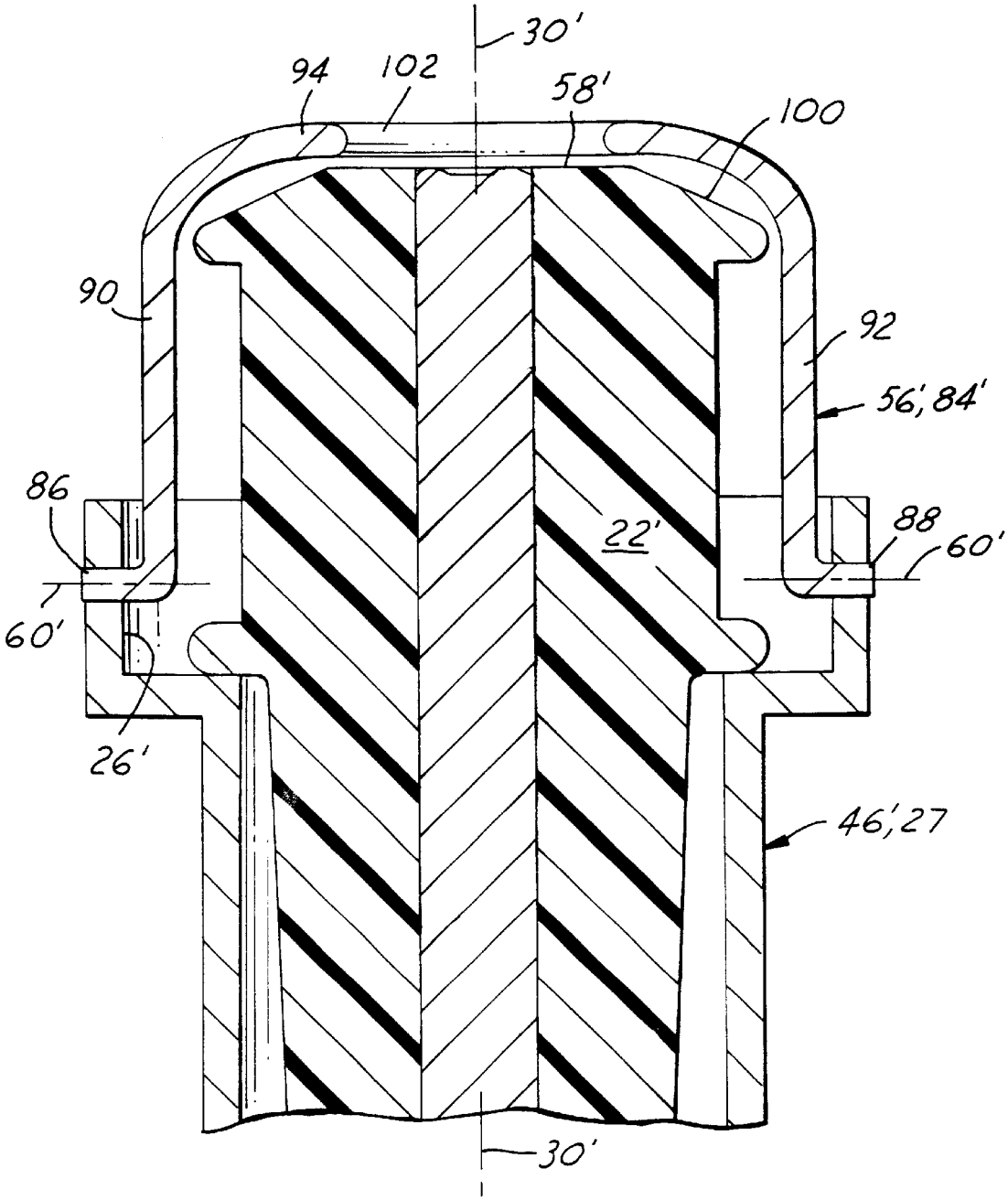
FIG. 6 is a partial cross-section side view of the spark plug boot keeper assembly of FIG. 4.

A substantial portion of the boot 22 is surrounded by an internal surface 26 of a structure 27 engaged to an engine, and the remaining portion of the boot 22 extends above the internal surface 26. The internal surface 26 defines a spark plug well 28 having a vertical centerline 30 and has an upper wall 32 aligned about the centerline 30 and extending downward toward an upper shelf 36 of the internal surface 26. The upper shelf 36 extends radially inward from the upper wall 32 to a lower wall 38 aligned about the centerline 30. The lower wall 38 of the internal surface 26 extends downward to a bottom shelf 40 which extends radially inward to an inner perimeter which defines an aperture 42 centered about the centerline 30. The structure 27, which defines the internal surface 26, is a combustion engine block 44 (as shown in FIGS. 6 and 7) or a heat shield 46 secured rigidly to the engine block 44 (as shown in FIGS. 1–4).

Figure 1:
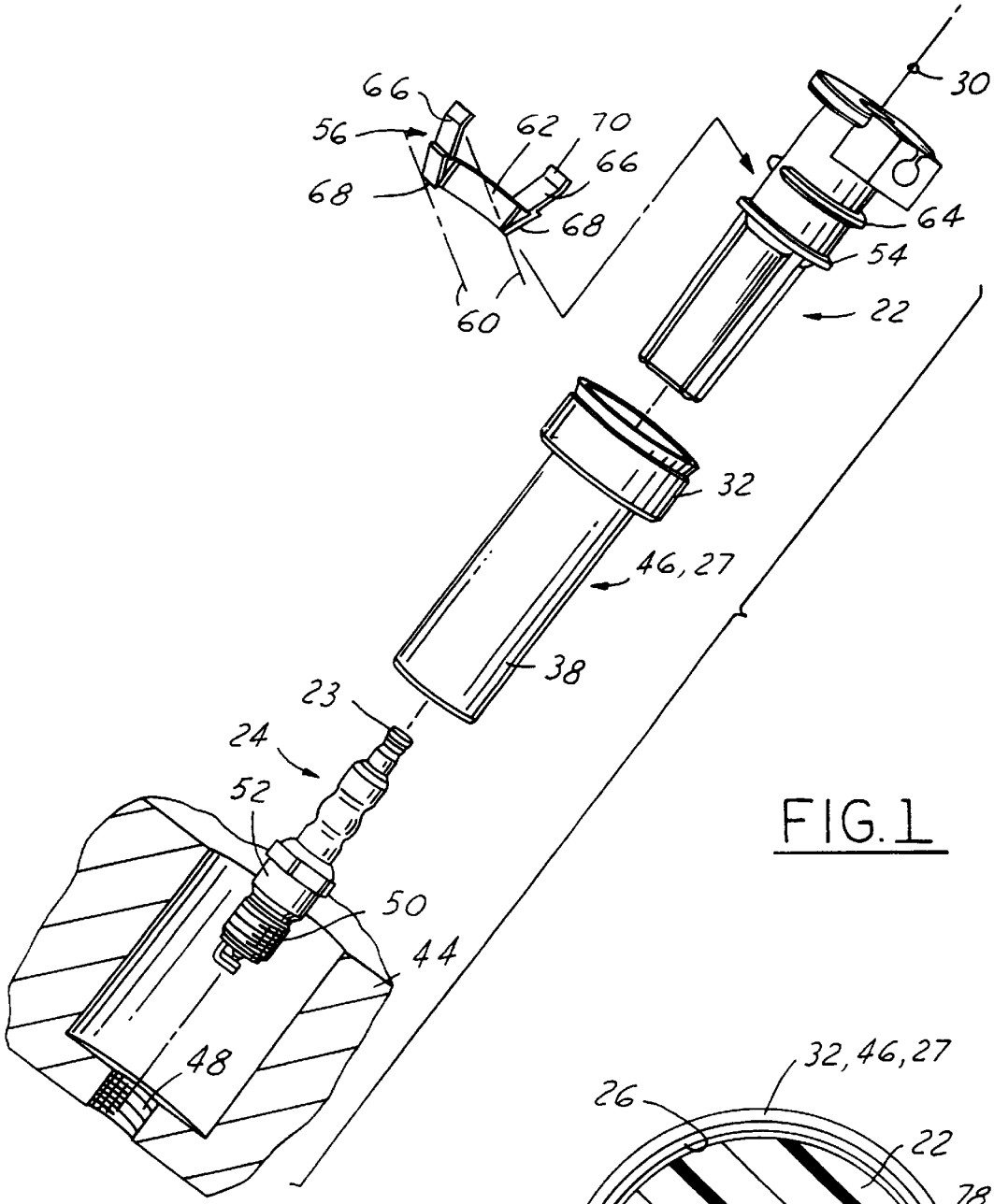
FIG. 1 is an exploded side view of a first embodiment of a spark plug boot keeper assembly of the present invention.
Figure 3:
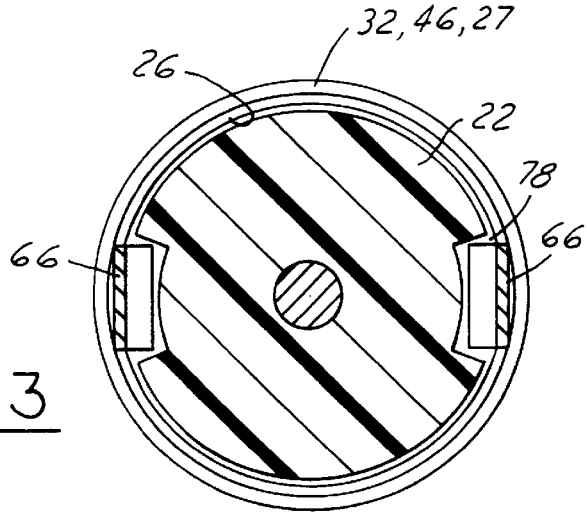
FIG. 3 is a cross-section view of the spark plug boot keeper assembly taken along line 3—3 shown in FIG. 2.
Figure 2:
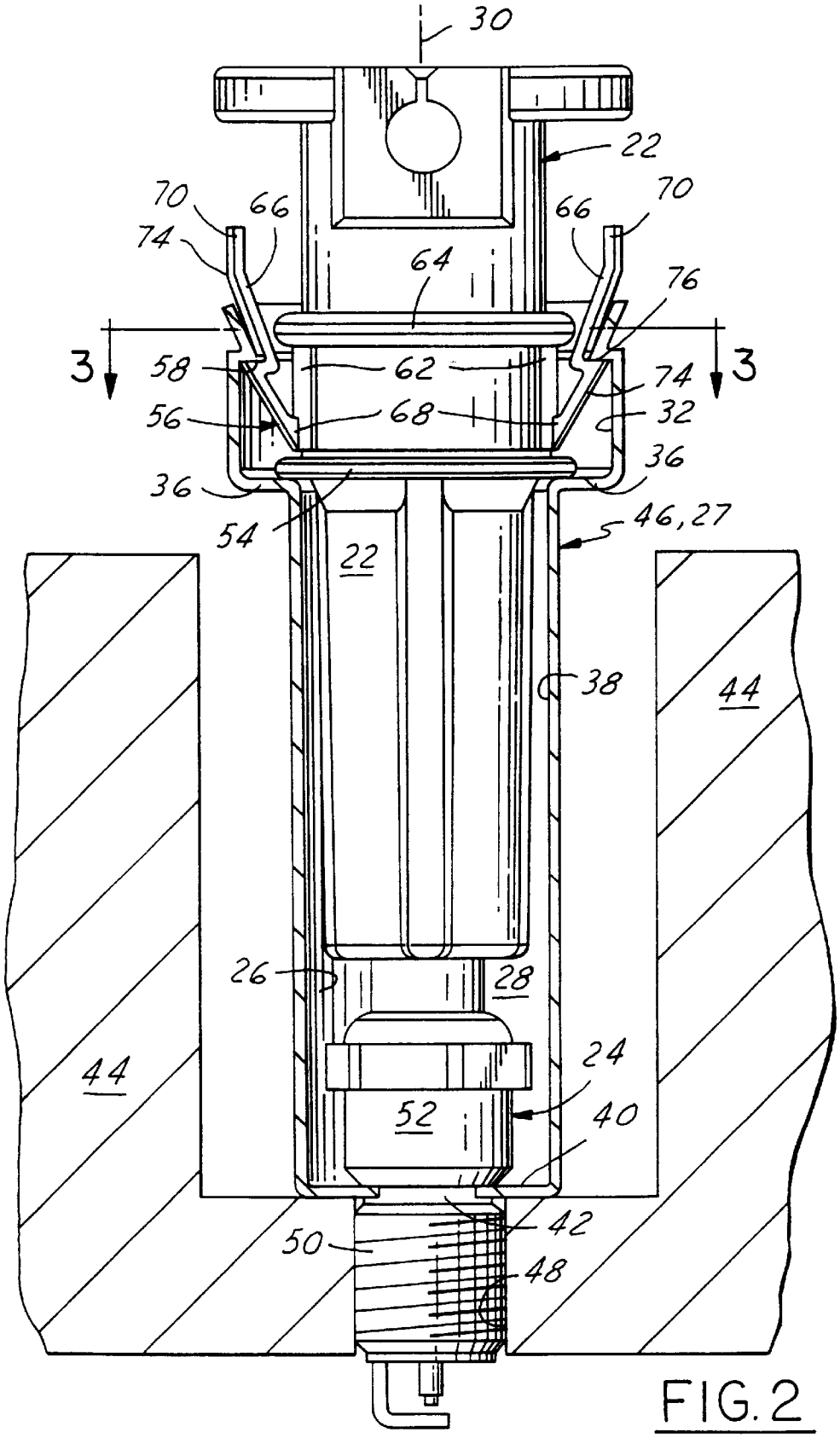
FIG. 2 is a partial cross-section view of the spark plug boot keeper assembly.

In a first embodiment illustrated in FIGS. 1–3, the internal surface 26 is defined by the elongated heat shield 46. The bottom shelf 40 rests upon the engine block 44 so that the aperture 42 is centered over a female threaded hole 48 of the engine block 44 which threadably engages the spark plug 24. With the heat shield 46 engaged over the engine block 44, the spark plug 24 is moved down into the well 28 and a threaded portion 50 of the spark plug 24 is inserted through the aperture 42 threading into the hole 48 of the engine block 44. The spark plug 24 has a mid portion 52 concentrically engaged to the threaded portion 50 from above. The diameter of the mid portion 52 is greater than the diameter of the aperture 42 and the diameter of the threaded portion 50. An underneath annular surface of the mid portion 52 engages the internal surface 26 of the bottom shelf 40 thereby clamping the heat shield 46 to the engine block 44. The aperture 42 and the spark plug 24 align to the centerline 30 of the well 28.

With the heat shield 46 mounted rigidly to the engine block 44 and the spark plug 24 installed, the spark plug boot 22 is fitted down upon a top terminal portion of the spark plug 24. A unitary circumferential lower rib 54 of the boot 22 extends radially outward and contacts the upward facing upper shelf 36 of the internal surface 26 when the boot 22 is fully inserted. The contact of the lower rib 54 with the upper shelf 36 not only acts as a positive indication that the boot 22 is properly seated onto the spark plug 24 but it also assures correct axial alignment for engagement of the boot keeper assembly 20.

Integral or interconnected between the upper wall 32 of the heat shield 46 and that portion of the boot 22 above the lower rib 54 is a pivoting member 56 which locks onto a lock face 58. The pivoting member 56 has at least one pivoting axis 60 which is spaced from centerline 30 and lies in a plane that is substantially perpendicular to the centerline 30. The lock face 58, which also is spaced from centerline 30 and lies in a plane that is substantially perpendicular to the centerline 30 and preferably annular in shape, engages the pivoting member 56 thereby preventing disengagement of the boot 22 from the spark plug 24 along the centerline 30.

In the first embodiment, the pivoting member 56 is integral or mounted to the boot 22, and the lock face 58 faces downward and is integral to the upper wall 32 of the heat shield 46. The pivoting member 56 has a collar 62 which laterally fits via an interference or snap fit onto the boot 22 and axially aligns directly above the lower rib 54 and directly below an upper rib 64. The lower and upper ribs 54, 64 prevent axial movement of the pivoting member 56 with respect to the boot 22 when fitting or withdrawing the boot 22 from around the spark plug 24. Extending radially outward and upward from the collar 62 is at least one and preferably two flex arms 66 that each pivot about an axis 60 as defined above. The flex arms 66 extend between a pivot end 68 secured to the collar 62 and a distal end 70 which extends upward above the upper wall 32 of the heat shield 46 preferably in a Z-shape or lightening bolt configuration.

The flex arm 66 has a radially outward facing surface 74 extending between the pivot and distal ends 68, 70. When inserting the boot 22 into the heat shield 46, a lateral force is applied against the outward surface 74 flexing the arms 66 inward. The ramping configuration of the outward surface 74 between the pivot end 68 and an upward facing ledge 76 of the flex arm 66 provides the lateral force necessary by contacting the upper wall 32 of the internal surface 26 forcing the flex arms 66 to flex radially inward as the boot 22 moves downward. To assist in the inward flexing of the flex arms 66, a lateral force can also be applied to the outward surface 74 near the distal ends 70 by direct human intervention as the boot 22 is pushed downward.

Preferably, the upper rib 64 has discontinuities or clearances 78 (shown in FIG. 3) aligned circumferentially with the flex arms 66 which permit the flex arms 66 to move even further inward providing maximum radial clearance between the lock face 58 of the upper wall 32 and the ledge 76 of the flex arm 66. When the lower rib 54 contacts the annular upper shelf 36 of the heat shield 46, the flex arms 66 will snap back, radially outward, and the lock face 58 will then oppose or face the flex arm ledge 76, making contact should the boot 22 attempt to lift upward away from the spark plug 24.

To disengage the boot 22 from the heat shield 46 the distal ends 70 of the respective flex arms 66 are forced radially inward until the upward facing flex arm ledge 76 moves radially inward until it clears the lock face 58 of the heat shield 46. Once cleared, the boot 22 is free to lift out of the heat shield 46 without interference from the locking mechanism 20.

Figure 4:
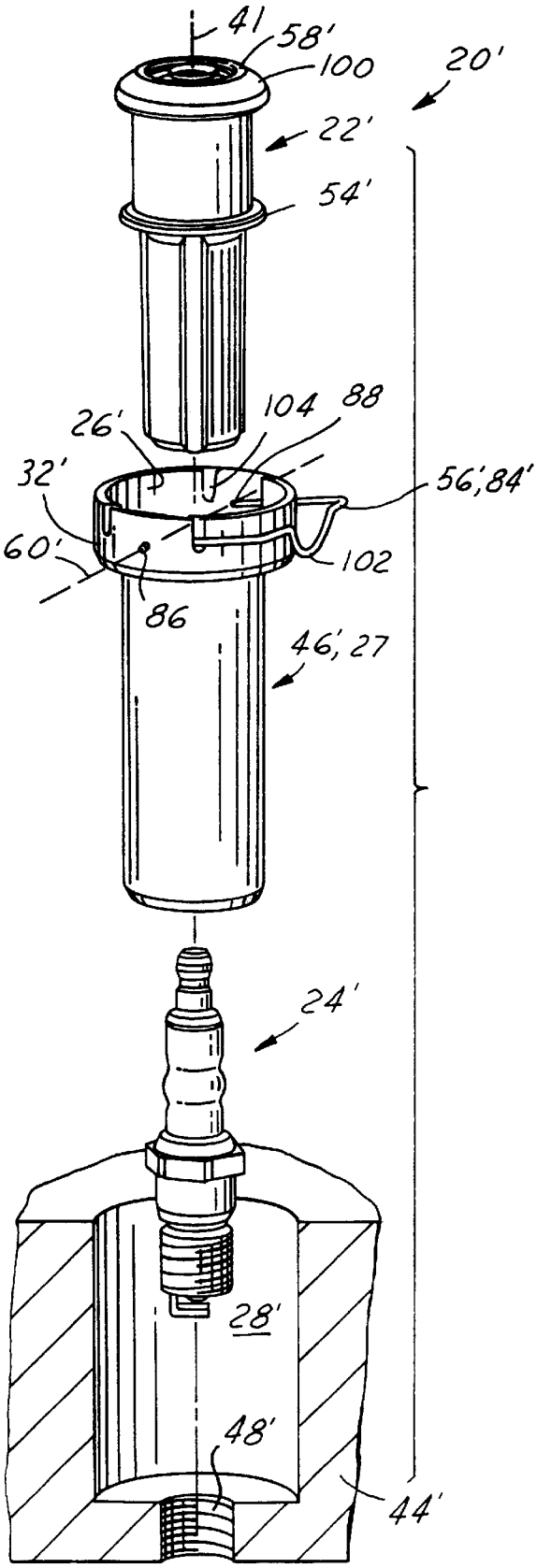
FIG. 4 is an exploded perspective view of a second embodiment of a spark plug boot keeper assembly of the invention.
Figure 5:
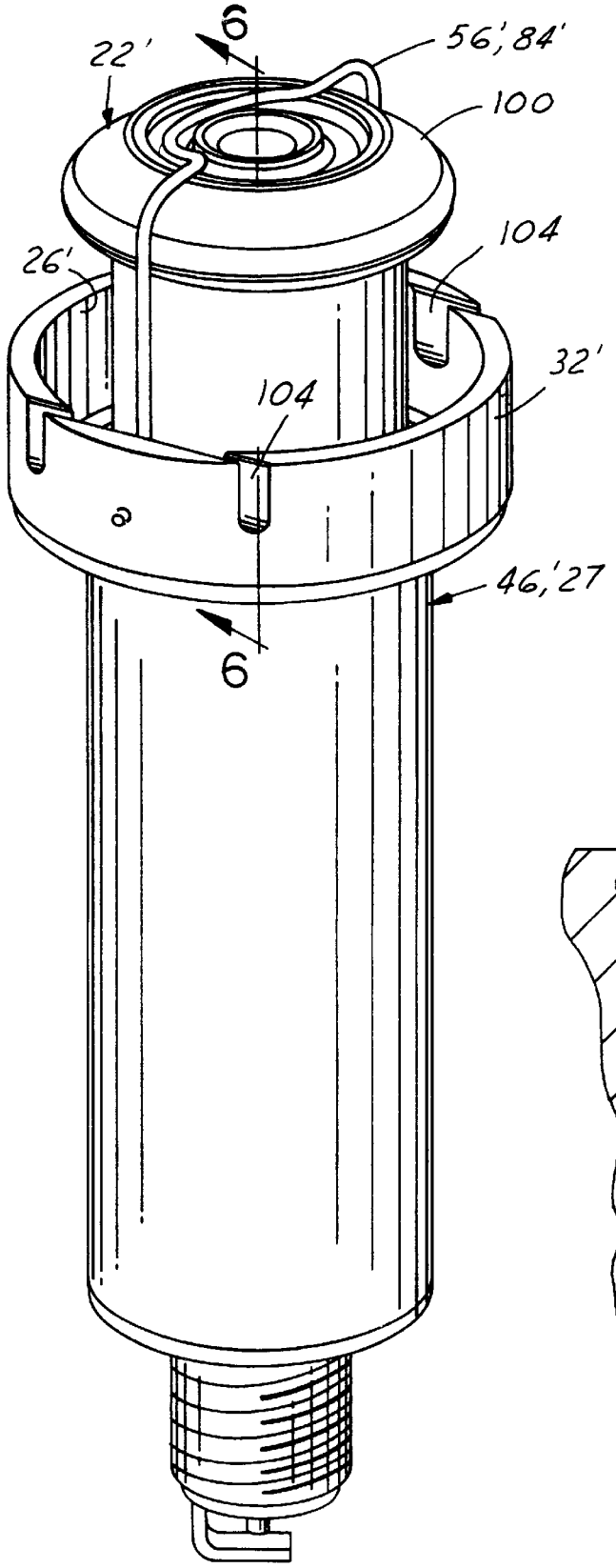
FIG. 5 is an assembled perspective view of the spark plug boot keeper assembly of FIG. 4 without an engine block to show detail.

Referring to FIGS. 4–6, a second embodiment of the present invention is shown. Unlike the first embodiment, the pivoting member 56' is integral or pivotally engaged to the upper wall 32' of the heat shield 46' and not the boot 22'. The pivoting member 56' is a U-shaped wire latch 84' which pivots about a central pivoting axis 60' which is perpendicular to and transverses the centerline 30'. The wire latch 84' has a first foot 86 and a second foot 88 which extend through the upper wall 32' of the heat shield 46'. Extending perpendicularly from the first foot 86 is a first leg 90 and likewise a second leg 92 from the second foot 88. The first leg 90 is substantially parallel to the second leg 92. Interconnecting the first and second legs 90, 92 is a central portion 94. When the pivoting member 56' or wire latch 84' is engaged, the central portion 94 is engaged to a lock face 58' which faces substantially upward and defines the top of the boot 22' and the first and second legs 90, 92 are substantially parallel to the centerline 30'. The first and second legs 90, 92 are of sufficient length so that the central portion 94 clears an outward perimeter edge 100 of the boot 22' when the wire latch 84' is pivoted upward. The boot perimeter edge 100 may be beveled or sloped downward as it extends radially outward from the centerline 30' to assist in clearing the central portion 94 as the wire latch 84' pivots upward to engage the boot 22'.

The central portion 94 generally bisects the lock face 58'. If the lock face 58' aligns about the centerline 30' and an ignition cable (not shown) protrudes concentrically from the lock face 58', the central portion 94 will preferably have a divot 102 in order to avoid interference between the central portion 94 of the wire latch 84' and the ignition cable.

The upper wall 32' of the heat shield 46' preferably has a pair of parallel slots 104, each extending substantially tangentially in both directions from the internal surface 26' of the heat shield 46' where the pivot axis 60' intersects the wall 32'. When the wire latch 84 is disengaged, the first and second legs 90, 92 will pivot into the respective slots 104, thereby providing maximum lateral clearance between the boot 22' and the central portion 94 of the wire latch 84'.

Referring to FIG. 7, a third embodiment of the present invention is shown. The third embodiment is similar to the first embodiment except that the third embodiment does not utilize a heat shield. The interior surface 26" of the third embodiment is defined by the engine block 44". That is, the engine block 44" itself provides the internal surface 26 described above and which is identified here as 26". Surface 26" conforms to the internal shape of surface 26 of the heat shield 46 of the first embodiment.

Figure 8:
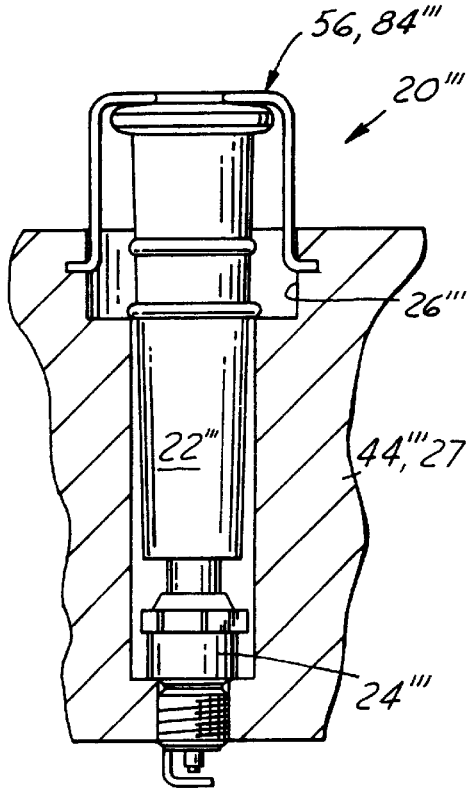
FIG. 8 is a cross-section side view of a fourth embodiment of a spark plug boot keeper assembly of the invention.

Referring to FIG. 8, a fourth embodiment of the present invention is shown. The fourth embodiment is similar to the second embodiment, but like the third embodiment, a heat shield is not utilized in the fourth embodiment. The engine block 44'" of the fourth embodiment defines a surface 26'" that conforms in shape to the internal surface 26' of the second embodiment. The first and second foot 86'", 88'" of wire latch 84'" no longer pivot within a heat shield but are actually engaged through the internal surface 26'" and into the engine block 44'".

Although the preferred embodiments of the present invention have been disclosed, various changes and modifications may be made thereto by one skilled in the art without departing from the scope and spirit of the invention as set forth in the appended claims. It is also understood that the terms used herein are merely descriptive, rather than limiting. For instance, the spark plug well can be inverted or turned upside down, so that the upper surfaces, shelves, etc. now become the lower surfaces, shelves, etc. It is therefore understood that various changes may be made without departing from the scope and spirit of the invention.

What is claimed is:

1. A spark plug boot keeper assembly comprising:

a spark plug;

a spark plug boot engaged to the spark plug, the boot having a circumferential lower rib extended radially outward; and a structure having an internal surface defining an elongated well having a centerline, the internal surface having an upper wall and an upper shelf, the upper wall extended upward from the upper shelf, the upper shelf extended radially inward from the upper wall;

the spark plug and spark plug boot disposed within the spark plug well, wherein the lower rib engages the upper shelf when the spark plug is fully inserted into the boot; and a pivoting member interconnected between the upper wall and the spark plug boot above the lower rib.

2. The spark plug boot keeper assembly as set forth in claim 1 further comprising:

the pivoting member having a pivot axis lying in an imaginary plane disposed perpendicular to a centerline of the well; and the structure having a locking face engaged to the pivoting member preventing disengagement of the spark plug boot from the spark plug, the locking face interconnected between the spark plug boot and the upper wall.

3. The spark plug boot keeper assembly as set forth in claim 2 wherein the pivoting member is mounted to the boot and wherein the locking face is defined by the upper wall and faces downward.

4. The spark plug boot keeper assembly as set forth in claim 3 wherein the pivoting member is a plurality of flex arms spaced circumferentially about the boot, the pivot axis being one of a plurality of pivot axis of each respective one of the plurality of flex arms, each one of the plurality of pivot axis being tangential to the boot, each one of the plurality of flex arms being radially biased and extending axially upward from the pivot axis.

5. The spark plug boot keeper assembly as set forth in claim 4 wherein each one of the plurality of flex arms having an upward facing ledge for engaging the locking face.

6. The spark plug boot keeper assembly as set forth in claim 5 further comprising a collar unitarily formed to the plurality of flex arms, the collar disposed about and engaged to the boot above the lower rib and below an upper rib, the lower and upper ribs thereby preventing axial movement of the collar with respect to the boot.

7. The spark plug boot keeper assembly as set forth in claim 6 wherein the structure defining the interior surface is a heat shield.

8. The spark plug boot keeper assembly as set forth in claim 6 wherein the structure defining the interior surface is an engine.

9. A spark plug boot keeper assembly comprising:

a spark plug;

a spark plug boot engaged to the spark plug, the boot having a circumferential lower rib extended radially outward; and a structure having an internal surface defining an elongated well having a centerline, the internal surface having an upper wall and an upper shelf, the upper wall extended upward from the upper shelf, the upper shelf extended radially inward from the upper wall;

the spark plug and spark plug boot disposed within the spark plug well, wherein the lower rib engages the upper shelf when the spark plug is fully inserted into the boot;

a pivoting member interconnected between the upper wall and the spark plug boot above the lower rib;

the pivoting member having a pivot axis lying in an imaginary plane disposed perpendicular to a centerline of the well;

the structure having a locking face engaged to the pivoting member preventing disengagement of the spark plug boot from the spark plug, the locking face interconnected between the spark plug boot and the upper wall; and wherein the pivoting member is mounted pivotally to the upper wall of the structure and wherein the locking face is defined by the boot and faces upward.

10. The spark plug boot keeper assembly as set forth in claim 9 wherein the pivoting member is a U-shaped bail wire having a first foot and an opposite second foot each extending radially outward into the upper wall of the structure, the first and second feet lying along the pivot axis, the pivot axis transversing the centerline.

11. The spark plug boot keeper assembly as set forth in claim 10 wherein the structure is a heat shield.

12. The spark plug boot keeper assembly as set forth in claim 11 wherein the structure is an engine.

13. A spark plug boot keeper assembly comprising:

a spark plug;

a spark plug boot engaged to the spark plug;

a heat shield engaged rigidly to an engine and defining an elongated well having a centerline, the heat shield having a bottom shelf, a lower wall, an upper shelf and an upper wall, the bottom shelf extending radially inward from the lower wall, the lower wall extending axially upward from the bottom shelf to the upper shelf, the upper shelf extending radially outward from the lower wall to the upper wall, the upper wall extending axially upward from the upper shelf, the upper wall having a locking face extended radially inward and facing downward, the spark plug engaged threadably to the engine, the bottom shelf engaged between the spark plug and the engine, the spark plug and spark plug boot disposed within the spark plug well; and a plurality of flex arms spaced circumferentially about the boot, each one of the plurality of flex arms having a pivot axis, a pivot end, an opposite distal end and an upward facing ledge disposed between the pivot end and the distal end, the pivot end interconnected to the boot, the pivot axis of each one of the plurality of flex arms lying within an imaginary plane disposed perpendicular to the centerline, the distal end disposed radially outward and upward from the pivot end, the upward facing ledge engaged to the downward facing locking face.

14. The spark plug boot keeper as set forth in claim 13 wherein each one of the plurality of flex arms have a radially outward facing surface extending from the pivot end to the distal end, the upward facing ledge disposed on the outward facing surface.

15. The spark plug boot keeper as set forth in claim 14 further comprising a collar unitarily formed to the plurality of flex arms, the collar disposed about and engaged to the boot.

16. The spark plug boot keeper as set forth in claim 15 wherein the plurality of flex arms are two flex arms and the distal ends of each one of the two flex arms extend above the heat shield, wherein a force directed radially inward against the distal ends and which is greater than the resilient force of the two flex arms will release the upward facing ledge of each flex arm from the locking face of the heat shield.

17. A spark plug boot keeper assembly comprising:

a spark plug;

a spark plug boot engaged to the spark plug;

a heat shield rigidly engaged to an engine and defining an elongated well having a centerline, the heat shield having a bottom shelf, a lower wall, an upper shelf and an upper wall, the bottom shelf extended radially inward from the lower wall, the lower wall extended axially upward from the bottom shelf to the upper shelf, the upper shelf extended radially outward from the lower wall to the upper wall, the upper wall extended axially upward from the upper shelf, the spark plug engaged threadably to the engine, the bottom shelf engaged between the spark plug and the engine block, the spark plug and spark plug boot disposed within the spark plug well;

a U-shaped bail wire engaged pivotally to the upper wall of the heat shield, the bail wire having a central portion disposed between a first and an opposite second foot, the first and second feet extending radially outward in relation to the centerline through the upper wall, the first and second feet lying along a pivot axis transversing the centerline; and a locking face directed upwardly and formed to the boot, the central portion of the wire latch engaged to the locking face of the boot when pivoted upward locking the boot down upon the spark plug.

* * * * *